US005342724A

United States Patent [19]

Wilson

[11] Patent Number: 5,342,724

[45] Date of Patent: Aug. 30, 1994

[54] TONER MANUFACTURE USING CHAIN TRANSFER POLYESTERS

[75] Inventor: John C. Wilson, Rochester, N.Y.

[73] Assignee: Eastman Kodak Company, Rochester, N.Y.

[21] Appl. No.: 867,307

[22] Filed: Apr. 10, 1992

[51] Int. Cl.[5] ..... G03G 9/08; G03G 9/13

[52] U.S. Cl. ..... 430/114; 430/107; 430/108; 430/109; 430/110; 430/111; 430/115; 430/907; 430/908; 525/445

[58] Field of Search ..... 430/114, 115, 253, 271, 430/273, 281, 288, 907, 106.6, 107, 109, 110, 111; 525/445

[56] References Cited

U.S. PATENT DOCUMENTS

| | | | |
|---|---|---|---|
| 3,391,082 | 7/1968 | Maclay . | |
| 3,459,787 | 8/1969 | Weesner . | |
| 3,502,582 | 3/1970 | Clemens et al. . | |
| 3,513,133 | 5/1970 | Weesner . | |
| 4,016,332 | 4/1977 | Anderson et al. . | |
| 4,148,741 | 4/1979 | Bayley . | |
| 4,156,764 | 5/1979 | White | 526/211 |
| 4,518,724 | 5/1985 | Kuwajima et al. | 523/501 |
| 4,533,614 | 8/1985 | Fukumoto et al. | 430/99 |
| 4,557,991 | 12/1985 | Takagiwa et al. | 430/109 |
| 4,758,626 | 7/1988 | Ishihara et al. | 525/148 |
| 4,833,060 | 5/1989 | Nair et al. . | |
| 4,835,084 | 5/1989 | Nair et al. | 430/137 |
| 4,942,105 | 7/1990 | Yu | 430/59 |
| 4,965,131 | 10/1990 | Nair et al. | 430/137 X |
| 4,985,328 | 1/1991 | Kumagai et al. | 430/110 |

FOREIGN PATENT DOCUMENTS

| | | |
|---|---|---|
| 1102037 | 5/1981 | Canada . |
| 2757429 | 7/1979 | Fed. Rep. of Germany . |
| 3729496 | 3/1988 | Fed. Rep. of Germany . |
| 47-6749 | 2/1972 | Japan . |
| 49-2196 | 1/1974 | Japan . |
| 51-109093 | 9/1976 | Japan . |
| 51-35514 | 10/1976 | Japan . |
| 51-049212 | 12/1976 | Japan . |
| 59-226053 | 12/1984 | Japan . |
| 61-009416 | 1/1986 | Japan . |
| 61-179202 | 8/1986 | Japan . |
| 63-070861 | 3/1988 | Japan . |

OTHER PUBLICATIONS

M. L. Hallensleben, "Copolymers From Disulphide Polymers and Vinyl Monomers By Radical Chain Transfer", 13 *European Polymer Journal* 437–40 (1970).

Y. Chujo, et al., "Synthesis of Segmental Copolyamides By Using Telechelic Prepolymers", 185 *Makromol. Chem.* 2077–87 (1984).

T. Miyashita, et al., "Kinetics of the Thermal Decompositions of Diaryl and Dialkyl Disfulfides", 48 *Bull. of the Chem. Soc'y of Japan* 3230–35 (1975).

Abstract No. 88–072331/11 of European patent application Ser. No. 259868, dated Mar. 16, 1988.

Abstract No. 89–055485/08 of European patent application Ser. No. 304040, dated Feb. 22, 1989.

*Primary Examiner*—John Kight, III
*Assistant Examiner*—Shelley A. Dodson
*Attorney, Agent, or Firm*—Willard G. Montgomery

[57] ABSTRACT

Polymeric electrophotographic toner and developer compositions are produced by methods including conventional as well as limited coalescence manufacturing techniques. The compositions are prepared by heating a diacid and a diol under conditions effective to form a chain transfer polyester, wherein either the diacid or the diol contain a disulfide moiety. The polyester is reacted with one or more vinyl monomers to form a block copolymer having polyester blocks linked to polyvinyl blocks by sulfide groups previously constituting the disulfide moiety. The block copolymer is reduced to a particulate form to a size suitable for use as an electrophotographic toner by conventional methods, evaporation limited coalescence, and suspension limited coalescence.

38 Claims, No Drawings

TONER MANUFACTURE USING CHAIN TRANSFER POLYESTERS

FIELD OF THE INVENTION

This invention relates to polymeric toner and developer compositions and to a method for preparing the same. More particularly, this invention relates to a method for preparing toner particles by polymerization and other processes including limited coalescence techniques.

BACKGROUND OF THE INVENTION

Electrographic imaging processes and techniques have been extensively described in patents and other literature. These processes may take the form of electrophotographic techniques whereby a photoconductive insulating material is first electrostatically charged and then imagewise exposed with light to form a latent image. Exemplary electrophotographic imaging processes are disclosed in U.S. Pat. Nos. 2,221,776; 2,277,013; 2,297,691; 2,357,809; 2,551,582; 2,825,814; 2,833,648; 3,220,324; 3,220,831; 3,220,833 and many others.

Generally, these processes have in common the steps of forming a latent electrostatic charge image on an insulating electrographic element. The electrostatic latent image is then rendered visible by treatment with an electrostatic developing composition or developer.

Conventional developers include a carrier that can be either a triboelectrically chargeable, magnetic material such as iron filings, powdered iron or iron oxide, or a triboelectrically chargeable, non-magnetic salt such as sodium or potassium chloride. In addition to the carrier, electrostatic developers include a toner which is electrostatically attractable to the carrier. Useful toners include powdered pigment resins made from various thermoplastic and thermoset remains such as polyacrylates, polystyrene, poly(styrene-coacrylate), polyesters, phenolics and the like, and can contain colorants such as carbon black or organic pigments or dyes. Other additives such as charge control agents and surfactants can also be included in the toner formulation.

Other examples of suitable toner compositions include: the polyester toner compositions of U.S. Pat. No. 4,140,644, the polyester toners having a p-hydroxybenzoic acid recurring unit of U.S. Pat. No. 4,446,302, the toners containing branched polyesters of U.S. Pat. No. 4,217,440, and the crosslinked styrene-acrylic toners and polyester toners of U.S. Pat. No. Re. 31,072, the phosphonium charge agents of U.S. Pat. No. 4,496,643, and the ammonium charge agents of U.S. Pat. Nos. 4,394,430, 4,323,634, and 3,893,935. These toners can be used with plural component developers with the various carriers such as the magnetic carrier particles of U.S. Pat. No. 4,546,060 and the passivated carrier particles of U.S. Pat. No. 4,310,611.

Toner binder compositions can be manufactured by various methods. For example, conventional condensation polymerization, such as disclosed in U.S. Pat. No. 4,140,644 to Sandhu, et al., U.S. Pat. No. 4,217,440 to Barkey, and U.S. Pat. No. Re. 31,072 to Jadwin, et al, is often utilized. Toners can also be manufactured by a form of suspension polymerization known as "limited coalescence". Exemplary limited coalescence techniques are described, for example, in U.S. Pat. No. 4,833,060 to Nair, et al., U.S. Pat. No. 4,835,084 to Nair, et al., and U.S. Pat. No. 4,965,131 to Nair, et al.

It is known that, depending on the type and nature of the resin(s) used, the resulting toner will exhibit varying physical properties. For example, the branched polyester toners disclosed in U.S. Pat. No. 4,217,440 exhibit such favorable properties as high glossability, good flow properties during fusing, easy dispersibility of pigment, higher grindability, and superior charging rates as positive toners. In addition, dyes are generally more soluble in branched polyesters and it is generally easier to disperse pigment in branched polyesters. Toners derived from the polymerization of vinyl monomers exhibit superior fuser reliability in that the toner particles do not accumulate or stick to the fusing roll as readily as typical polyester toner particles.

Because the favorable properties exhibited (or not) by a toner are often a product of the toner binder's structure, there are few toner compositions that exhibit the properties of, for example, both a polyester and a polyvinyl toner. Therefore, there continues to be a need for toners exhibiting the various favorable properties outlined above that can be practicably made by known methods of toner manufacture.

SUMMARY OF THE INVENTION

In accordance with the present invention, a method of making a toner composition that exhibits the favorable properties of both polyester and polyvinyl toners is disclosed. The method of the present invention includes the steps of heating a diacid and a diol, wherein either the diacid or the diol contain a disulfide moiety, under conditions effective to form a polyester. The formed polyester, a "chain transfer" polyester, is then reacted with one or more vinyl monomers and an initiator under conditions effective to produce a block copolymer. The block copolymer comprises polyester blocks linked to polyvinyl blocks by sulfide groups that previously constituted the disulfide moiety. The block copolymer is reduced to a particulate form to a size suitable for use as an electrographic toner. Optionally, the polyester can be prepared with hydroxy group termination and subsequently chain extended with a disulfide diisocyanate to give a polyester-polyurethane containing disulfide moieties. The formed chain transfer polymer can then be reacted with one or more vinyl monomers and an initiator under conditions to produce a block copolymer.

The block copolymers formed by the method of the present invention can be reduced to a particulate form by any known method. For example, appropriately sized particles can be produced by crushing and melt blending the crushed block copolymer, optionally with toner addenda, recrushing and coarse grinding the melt blended block copolymer, and pulverizing the recrushed and ground block copolymer blend to a particulate form to a size suitable for use as an electrographic toner.

Another embodiment of the present method includes the block copolymer dissolved in an organic solvent, and toner addenda if desired, to form an organic phase. A stabilizer and, optionally, a promoter are mixed in a suspending liquid which is immiscible with the organic phase to form a continuous phase. Next, the organic and continuous phases are mixed under high shear to form a suspension of small droplets of the organic phase suspended in the continuous phase. The droplets, with stabilizer particles on their surfaces, coalesce to form larger droplets. The stabilizer particles limit this coalescence and define the size of the resultant droplets. The organic solvent is then removed from the droplets to form solidified polymeric toner particles.

A third embodiment of the inventive method includes the steps of mixing the chain transfer polyester with a polymerizable vinyl monomer, an initiator, and any desired toner addenda to form an organic phase, followed by mixing a stabilizer, a buffering agent, and a promoter in a suspending liquid which is immiscible with the organic phase (i.e., the organic solvent, chain transfer polyester, vinyl monomer, and initiator) to form a continuous phase. The continuous and organic phases are mixed to form a suspension of small droplets of the organic phase suspended in the continuous phase. After the droplets coalesce as limited by the stablizer, the vinyl monomer is polymerized with the chain-transfer polyester under conditions effective to form particles of block copolymer having polyester blocks linked to polyvinyl blocks by sulfide groups that previously constituted the disulfide moiety.

The method of the present invention provides polymeric toner particles that have the favorable properties and features of both polyesters and polyvinyls. In addition, the present method produces the polyester-polyvinyl toners using known methods of toner manufacture. Also, the present method provides a method of inserting highly reactive functional groups into copolyesters. Copolyesters containing these highly reactive functional groups can subsequently serve as substrates for further chemical reactions with various reagents to further modify the properties of the inventive polyester-polyvinyl block copolymers.

DETAILED DESCRIPTION OF THE INVENTION

In accordance with the present invention, disclosed is a toner comprising a block copolymer that is the polymerization product of a vinyl monomer and a chain transfer polyester containing a disulfide linkage. The toner can be prepared by any of the known methods of toner manufacture. Three methods of toner manufacture are disclosed. The toner of the present invention can be prepared by conventional toner manufacture processes, such as disclosed in U.S. Pat. No. 4,140,644 to Sandhu, et al., U.S. Pat. No. 4,217,440 to Barkey, and U.S. Pat. No. Re. 31,072 to Jadwin, et al; by "evaporation limited coalescence" techniques described, for example, in U.S. Pat. No. 4,833,060 to Nair, et al.; or by suspension polymerization limited coalescence techniques disclosed in U.S. Pat. No. 4,835,084 to Nair, et al., and U.S. Pat. No. 4,965,131 to Nair, et al.

The chain transfer polyester used to prepare the present toner is the product of a conventional two-stage polyesterification of a diacid or its derivative and a diol. Either the diacid or the diol must contain a disulfide moiety. Preferably, a polyfunctional modifier (i.e., a branching agent) is also included. As used throughout this specification and in the claims, the terms "diol", "diacid", "polyfunctional modifier", and "vinyl monomer" include a mixture of diols, a mixture of diacids, a mixture of polyfunctional modifiers, and a mixture of vinyl monomers, respectively.

The polyesterification comprises the steps of heating the diol and the diacid in the presence of a catalyst (e.g., zinc acetate, antimony (III) oxide) in an inert atmosphere (e.g., an atmosphere such as nitrogen or argon) at about 180° C. to about 280° C., preferably at about 220° C. to about 240° C. Next, a vacuum is applied at the upper temperature range, preferably about 240° C. to about 260° C., while continuing to heat the mixture to increase the molecular weight of the chain transfer polyester and to remove excess diol from the mixture. After the polyester has reached the appropriate molecular weight, the product of the polyesterification is cooled and isolated. Further details relating to two-stage polyesterification can be found in U.S. Pat. No. 4,140,644 to Sandhu et al.

The chain transfer polyester produced is characterized by the addition of one or more ester-forming compounds (e.g., a diacid or a diol) containing a disulfide group to copolymerize the disulfide-containing monomer with the other polyester monomers and, thereby, introduce the disulfide groups into the main polyester chain. For example, one class of chain transfer polyester produced by a disulfide-containing diacid and diol (or vice versa) by the above-described process has the general formula:

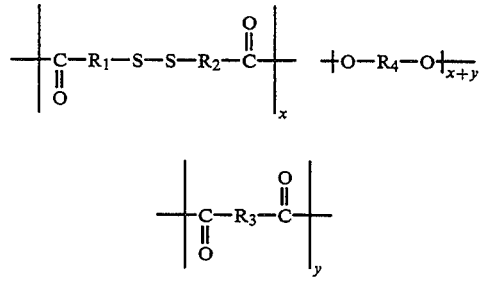

wherein $R_1$, $R_2$, $R_3$, and $R_4$ are the same or different and can include alkylene, arylene, arylenedialkylene and alkylene diarylene; and where x and y are mole fractions where x can range from 0.01 to 100.00 and $x+y=100$. A preferred chain transfer polyester is one with the above general formula where $R_1$, $R_2$ and $R_3$ are p-phenylene and where $R_4$ is 2,2-dimethyl-1,3-propylene and $x=1.0$ to 10.0.

In mixing the diol, diacid, and polyfunctional modifier, generally at least about 1.1 moles of diol are present for each mole of diacid, and preferably from about 1.3 to about 2.0 moles of diol are present for each mole of diacid. The concentration of polyfunctional modifier used in the reaction mixture is the concentration required to obtain a desired ratio of linearization to branching at a given inherent viscosity. This concentration can be conveniently determined by routine experimentation known in the art. The concentration of polyfunctional modifier is also dependent on the number of functional groups in the modifier molecule. In general, the more functional groups a modifier has, the less modifier is needed to achieve a desired amount of branching. As is understood in the art, the chemical and physical properties of resulting branched polyesters can be varied by the use of different concentrations of polyfunctional modifier. For information regarding the use of polyfunctional modifiers, see U.S. Pat. No. Re. 31,072 to Jadwin et al. the disclosure of which is hereby incorporated by reference. Typically, the concentration of polyfunctional modifier is in the range of from about 0.001 to about 10 mole percent, preferably from about 0.1 to about 5.0 mole percent, based on moles of diacid or glycol.

Diols useful in the practice of this invention are typically dihydric alcohols or their functional derivatives, such as esters, which are capable of condensing with diacids or their functional derivatives to form condensation polymers. These diols can be represented, for example, by the formula $R_5—O—R_6—O—R_7$ wherein each of $R_5$ and $R_7$ is hydrogen or alkylcarbonyl, preferably of from 2 to 7 carbon atoms. An alkylcarbonyl can be represented by the formula:

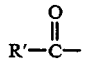

wherein R' is an alkyl preferably of from 1 to 6 carbon atoms. Representative alkylcarbonyl radicals are acetyl, propionyl, butyryl, etc. Most preferably, both $R_5$ and $R_7$ are hydrogen.

$R_6$ is an aliphatic, alicyclic or aromatic radical, preferably of 2 to 12 carbon atoms and, most preferably, of 2 to 6 carbon atoms. Typical aliphatic, alicyclic, and aromatic radicals include alkylene, cycloalkylene, alkylidene, arylene, alkylidyne, alkylenearylene, alkylenecycloalkylene, alkylenebisarylene, cycloalkylenebisalkylene, arylenebisalkylene, alkylene-oxy-alkylene, alkylene-oxy-arylene-oxyalkylene, etc. Preferably, $R_6$ is a hydrocarbon, such as alkylene, cycloalkylene, cycloalkylenebisalkylene or arylene.

Exemplary diols useful in the practice of this invention include ethylene glycol, diethylene glycol, triethylene glycol, 1,3-propanediol, 1,4-butanediol, 1,2-propanediol, 2-methyl-1,5-pentanediol, 1,4-cyclohexanedimethanol, 1,4-bis(β-hydroxyethoxy)benzene, norcamphanediols, 2,2,4,4-tetraalkylcyclobutane-1,3-diols, p-xylene glycol, hydroquinone, 4,4'-isopropylidenediphenol and corresponding alkyl esters thereof. Neopentyl glycol is especially useful in the process of the present invention.

Diacids useful in the practice of this invention are typically dicarboxylic acids which are capable of condensing with diols or their functional derivatives to form condensation polymers. As used throughout this specification and in the claims, the term "diacid" includes functional derivatives of diacids such as esters, acid halides or anhydrides. Useful diacids can be represented, for example, by the formula:

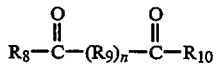

wherein n is 0 or 1, and both $R_8$ and $R_{10}$ are hydroxy, halogen, (e.g. flouro, chloro, etc.), or alkoxy, preferably of from 1 to 12 carbon atoms, (e.g., methoxy, ethoxy, t-butoxy, etc.), or $R_8$ and $R_{10}$ taken together form an oxy linkage. Most preferably, both $R_8$ and $R_{10}$ are hydroxy or alkoxy of 1 to 4 carbon atoms.

$R_9$ is an aliphatic, alicyclic or aromatic radical, preferably of 1 to 12 carbon atoms. The definition of $R_6$ given above applies here as well for $R_9$. Preferably, $R_9$ is hydrocarbon, such as alkylene, cycloalkylene or arylene.

Exemplary diacids useful in the practice of this invention include sebacic acid, 1,4-cyclohexanedicarboxylic acid, adipic acid, glutaric acid, succinic acid, carbonic acid, oxalic acid, azelaic acid, 4-cyclohexene-1,2-dicarboxylic anhydride, 2-ethylsuberic acid, 2,2,3,3-tetramethylsuccinic acid, 4,4'-bicyclohexyldicarboxylic acid, terephthalic acid, isophthalic acid, dibenzoic acid, bis(p-carboxyphenyl)methane, 2,6-naphthalenedicarboxylic acid, phenanthrene dicarboxylic acid, 4,4'-sulfonyldibenzoic acid and other similar acids including those disclosed, for example, in U.S. Pat. No. 3,546,180 to Caldwell, U.S. Pat. No. 3,929,489 to Arcesi, et al., and U.S. Pat. No. 4,101,326 to Barkey. As noted above, ester, acid halide and anhydride derivatives of these acids are also useful in the practice of this invention. Dimethyl terephthalate is especially useful as the diacid in the method of the present invention.

Polyfunctional modifiers useful in the practice of this invention are also known as branching agents. These modifiers contain three or more functional groups, such as hydroxyl or carboxyl. As used in this specification and in the claims, the terms "polycarboxylic acid", "polyol", and "hydroxy acid" also include functional equivalents, such as anhydrides and esters. Exemplary modifiers include polyols having three or more hydroxyl groups, polycarboxylic acids having three or more carboxyl groups and hydroxy acids having three or more total hydroxyl and carboxyl groups.

Representative polyfunctional modifiers are trimesic acid, trimellitic acid, trimellitic anhydride, pyromellitic acid, butanetetracarboxylic acid, naphthalenetricarboxylic acids, cyclohexane-1,3,5-tricarboxylic acid, glycerol, trimethylolpropane, pentaerythritol, dipentaerythritol, 1,2,6-hexanetriol, 1,3,5-trimethylolbenzene, malic acid, citric acid, 3-hydroxyglutaric acid, 4-(β-hydroxyethyl)phthalic acid, 2,2-dihydroxymethylpropionic acid, 10,11-dihydroxyundecanoic acid, 5-(2-hydroxyethoxy) isophthalic acid and others known in the art as disclosed, for example, in U.S. Pat. No. 4,013,624 to Hoeschele. Preferred polyfunctional modifiers include modifiers having three or four functional groups, such as trimellitic anhydride and penaterythritol, glycerol and trimethylolpropane.

To form a chain transfer polyester containing a disulfide moiety, a reactant containing a disulfide moiety must be added to the reaction mixture. The disulfide-containing reactant can be, therefore, one or more of the diacids or the diols mixed to form a chain transfer polyester. The polydisulfide/polyester used as a chain transfer polyester in the present method should have a chain transfer constant sufficiently high to permit reasonable activity. Chain transfer constants can be determined by the method described in detail below at Example 10. The chain transfer polyesters used in the present invention should have a chain transfer constant of at least about 0.03. Preferably, the chain transfer polyester has a chain transfer constant of at least about 0.20. Any diacid or diol containing a disulfide group and exhibiting the requisite chain transfer constant upon polyesterification can be used in the present process.

Examples of disulfides useful as the diacid in the method of the present invention include bis(4-carboxyphenyl) disulfide, bis(4-carbomethoxyphenyl) disulfide, 2,2'-dithio(dibenzoyl chloride), bis(4-chlorocarbonylphenyl) disulfide, dimethyl 4,4'-dithiodibutyrate, N,N'-bis(4-carbomethoxybenzoyl)-4,4'-dithiodianiline, bis(3-carboxyphenyl) disulfide, bis(2-carboxyphenyl) disulfide, 2,3'-dicarboxydiphenyl disulfide, 2,4'-dicarboxydiphenyl disulfide, 3,4'-dicarboxydiphenyl disulfide, bis(4-carboxymethylphenyl) disulfide, bis(3-carboxymethylphenyl) disulfide, bis(2-carboxymethylphenyl) disulfide, bis(10-carboxy-n-decyl) disulfide, 3,3'-dithiodipropionic acid, N,N'-bis(beta-carboxypropionyl)-4,4'-dithiodianiline, N,N'-bis(gamma-carboxybutyryl)-2,2'-dithiodianiline, bis(3-carboxy-1-methylpropyl) disulfide, bis(2,3-di-methoxy-6-carboxyphenyl) disulfide and bis(4-carboxy-methoxyphenyl) disulfides.

Disulfides useful as the diol in the method of the present invention include bis(gamma-hydroxypropyl) disulfide, bis(6-hydroxyhexyl) disulfide, bis(6-hydroxy-2-naphthyl) disulfide, bis(4-hydroxyphenyl) disulfide, bis(4-hydroxymethylphenyl) disulfide, bis(2-hydroxymethylphenyl) disulfide, bis(4-(beta-hydroxyethyl)-phenyl) disulfide, bis(3-(beta-hydroxyethyl)phenyl) disulfide, and the like.

In addition, the disulfide used in the method of the present invention can be a trifunctional or tetrafunctional compound. If a tri- or tetra-functional disulfide is used it can serve as both the disulfide-contributing reactant and as a branching agent. Examples of tri- and tetra-functional disulfides useful in the method of the present invention include 2,2',3-tricarboxydiphenyl disulfide,
2,3,3'-tricarboxydiphenyl disulfide,
2,3,4'-tricarboxydiphenyl disulfide,
2,2',4-tricarboxydiphenyl disulfide,
2,3',4-tricarboxydiphenyl disulfide,
2,4,4'-tricarboxydiphenyl disulfide,
2',3,4-tricarboxydiphenyl disulfide,
3,3',4-tricarboxydiphenyl disulfide,
3,3,4'-tricarboxydiphenyl disulfide,
bis(2,4-dicarboxyphenyl) disulfide,
bis(2,3-dicarboxyphenyl) disulfide,
bis(3,4-dicarboxyphenyl) disulfide,
2,2',3,4'-tetracarboxydiphenyl disulfide,
2,3,3',4-tetracarboxydiphenyl disulfide,
2,3',4,4'-tetracarboxydiphenyl disulfide.

The chain transfer polyesters used to prepare the present toner can also be formed by chain extending a hydroxy terminated polyester with a diisocyanate containing a disulfide moiety. This method provides an additional route for introducing the chain transfer moiety (i.e., the disulfide group) to the polyester under advantageously mild conditions (e.g., temperatures in the range of about 50°-100° C.). The resulting chain transfer polyester in this case is a polyester-polyurethane copolymer. For example, the resultant chain transfer polyester derived from chain extending the hydroxy terminated polyester derived from neopentyl glycol and terephthalic acid with bis(4-isocyanatophenyl) disulfide is:

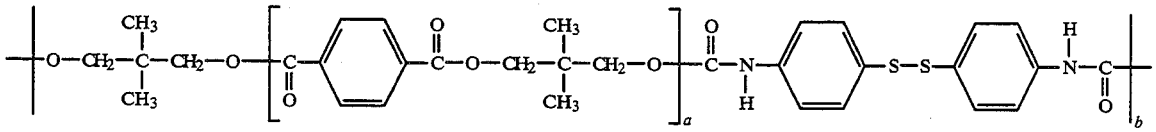

where a and b are values representing the average degree of polymerization. For the purposes of the present invention, the term "diacid" also includes diisocyanate disulfides as described above. Useful diisocyanate disulfides include bis(4-isocyantophenyl) disulfide, bis(3-isocyanatophenyl) disulfide, bis(isocyanatomethyl) disulfide, bis(2-isocyanatoethyl) disulfide, and bis(3-isocyanatopropyl) disulfide. Further details regarding the synthesis of a polyester-polyurethane chain transfer polyester as described above and its use can be found in Examples 14–16, infra.

Preferably, the disulfide used in the method of the present invention is selected from the group consisting of bis(4-carboxyphenyl) disulfide, bis(4-carbomethoxyphenyl) disulfide, bis(3-carboxyphenyl) disulfide, and bis(3-carbomethoxyphenyl) disulfide. An especially preferred disulfide is bis(4-carbomethoxyphenyl) disulfide.

The chain transfer polyester prepared according to the method outlined above is used as one of the reactants in preparing the toners of the present invention. The chain transfer polyester is reacted with a vinyl monomer in the presence of an initiator to produce a block copolymer having polyester blocks and polyvinyl blocks which are linked together by sulfide groups previously constituting part of the disulfide moiety. A generic form of this reaction (I) is illustrated below.

(I)

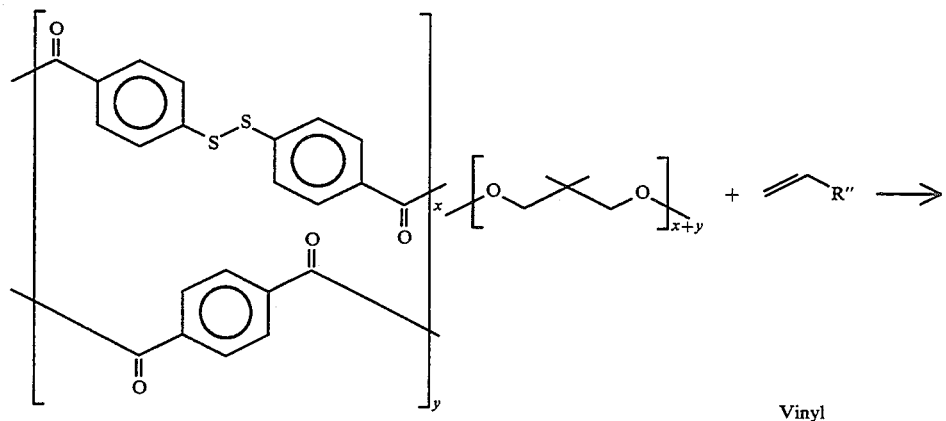

Chain Transfer Polyester

Vinyl Monomer

-continued (I)

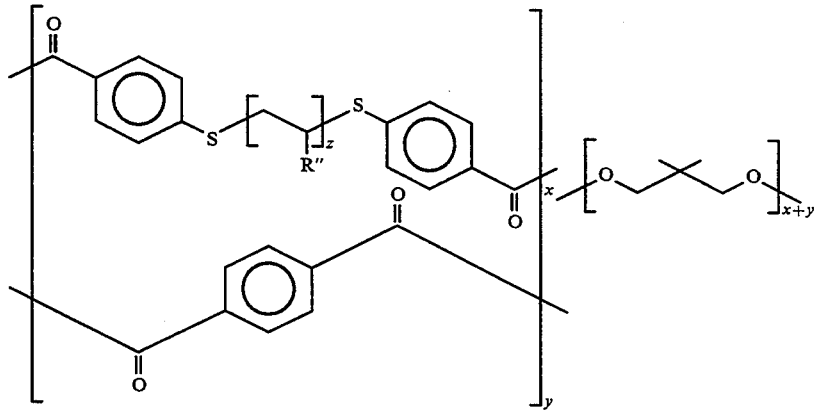

Block Copolymer

Essentially, the disulfide moiety reacts with free radicals formed in the polymerization process and the vinyl monomer is inserted between the sulfur atoms. The block copolymer is then reduced to a particulate form to a size suitable for use as an electrographic toner.

In one embodiment of the present method, a vinyl polymerization in the presence of a chain transfer polyester is performed and, subsequently, the resultant block copolymer is reduced to a particulate form to a size suitable for use as an electrographic toner. The vinyl polymerization is performed by dispersing the chain transfer polyester in a solvent such as tetrahydrofuran ("THF"), N,N-dimethylformamide ("DMF"), or 1,4-dioxane. For the purposes of this invention, the term disperse includes dissolving or suspending. The chain transfer polyester must be sufficiently dispersed to allow vinyl monomer which is added to the reaction solution to reach the disulfide moiety for insertion. Preferably, therefore, the chain transfer polyester is dissolved in an organic solvent.

Vinyl monomer is added to the chain transfer polyester solution and the solution is purged with an inert gas such as nitrogen or argon. An initiator, such as azobisisobutyronitrile or a peroxide such as lauroyl peroxide, is next typically added to the solution of chain transfer polyester and vinyl monomer. The vinyl polymerization generally is performed at a temperature between about 20° C. to about 100° C., depending on the initiator used. The temperature must be high enough to activate the initiator. For example, if the initiator is azobisisobutyronitrile, the reaction solution is maintained at a temperature of about 50° C. to 60° C. Other methods of generating radicals to carry out the vinyl polymerization in the absence of an initiator include exposure of the reaction solution to ultraviolet light or higher temperatures. Preferably, an initiator is used. The solution should be stirred under positive nitrogen pressure for 10–30 hours, or any suitable time for the highest conversion of the vinyl monomer.

The stirred solution is poured into a precipitating agent (e.g., cyclohexane) to precipitate a block copolymer. The precipitated block copolymer is rinsed with the precipitating agent and a ligroine (a combination of alkanes generally having a boiling point of about 35°–60° C.) to remove residual amounts of the vinyl monomer and/or vinyl polymer and is then dried. The resulting block copolymer is preferably further purified by redissolving in a solvent such as methylene chloride and repeating the steps of precipitating, washing, and drying the block copolymer.

In polymerizing the vinyl monomer in the presence of a chain transfer polyester, the degree of polymerization will be inversely proportional to the concentration of disulfide moiety.

Typical vinyl monomers useful in the present process include substituted and unsubstituted styrenes (e.g., styrene, m+p-chloromethylstyrene and the like), vinyl naphthalene, ethylenically unsaturated mono-olefins (e.g., ethylene, propylene, butylene, isobutylene and the like), vinyl halides (e.g. vinyl chloride, vinyl bromide, vinyl fluoride and the like), vinyl esters (e.g., vinyl acetate, vinyl propionate, vinyl benzoate, vinyl butyrate and the like), esters of alpha-methylene aliphatic monocarboxylic acids (e.g., methyl acrylate, ethyl acrylate, n-butyl acrylate, isobutyl acrylate, dodecyl acrylate, n-octyl acrylate, 2-chloroethyl acrylate, phenyl acrylate, methyl alpha-chloroacrylate, methyl methacrylate, ethyl methacrylate, butyl methacrylate and the like), acrylonitrile, methacrylonitrile, acrylamide, vinyl ethers (e.g., vinyl methyl ether, vinyl isobutyl ether, vinyl ethyl ether, and the like), vinyl ketones (e.g., vinyl methyl ketone, vinyl hexyl ketone, methyl isopropenyl ketone and the like), vinylidene halides (e.g., vinylidene chloride, vinylidene chlorofluoride and the like), N-vinyl compounds (e.g., N-vinylpyrrole, N-vinylcarbazole, N-vinylindole, N-vinylpyrrolidine and the like), and mixtures thereof.

Toner resins containing a relatively high percentage of styrene resins are typically preferred. The presence of a styrene resin is preferred because a greater degree of image definition is achieved with a given quantity of additive material. Further, denser images are obtained when at least about 25 percent by weight (based on the total weight of resin in the toner) of a styrene resin is present in the toner. The styrene resin can be a homopolymer of styrene or styrene homologues or copolymers of styrene with other monomeric groups containing a single methylene group attached to a carbon atom by a double bond. Thus, typical monomeric materials which can be copolymerized with styrene by addition polymerization include substituted styrenes (e.g, m+p-chloromethylstyrene, and the like), vinyl naphthalene, ethylenically unsaturated mono-olefins (e.g., ethylene, propylene, butylene, isobutylene and the like), vinyl halides (e.g., vinyl chloride, vinyl bromide, vinyl fluoride and the like), vinyl esters (e.g., vinyl acetate, vinyl propionate, vinyl benzoate, vinyl butyrate and the like), esters of alpha-methylene aliphatic monocarboxylic acids (e.g., methyl acrylate, ethyl acrylate, n-butyl acrylate, isobutyl acrylate, dodecyl acrylate, methyl alpha-chloroacrylate, methyl methacrylate, ethyl methacrylate, butyl methacrylate and the like), acrylonitrile, methacrylonitrile, acrylamide, vinyl ethers (e.g., vinyl methyl ether, vinyl isobutyl ether, vinyl ethyl ether, and the like), vinyl ketones (e.g., vinyl methyl ketone, vinyl hexyl ketone, methyl isopropenyl ketone and the like), vinylidene halides (e.g., vinylidene chloride, vinylidene chlorofluoride and the like), N-vinyl compounds (e.g., N-vinylpyrrole, N-vinylcarbazole, N-vinylindole, N-vinylpyrrolidine and the like), and mixtures thereof. The styrene resins can also be formed by the polymerization of mixtures of two or more of these unsaturated monomeric materials with a styrene monomer. Polystyrene and copolymers of styrene and n-butyl methylacrylate have been found to be particularly suitable for the method of the present invention as they result in polymers which are suitable for use as toner material as they possess good triboelectric and fusing properties.

Preferably, a mix of vinyl monomers is polymerized and at least one of the vinyl monomers is a divinyl compound which will act as a cross-linking agent. Cross-linking results in a copolymer with increased hot melt strength. Typical crosslinking agents of the present invention include aromatic divinyl compounds (e.g., divinylbenzene, divinylnaphthalene or their derivatives), diacrylates and dimethacrylates (e.g., diethyleneglycol dimethacrylate, and diethyleneglycol diacrylate), and any other divinyl compounds (e.g., divinyl sulfide or divinyl sulfone compounds), or mixtures thereof. Suitable cross-linking agents and their use are also disclosed in U.S. Pat. No. Re. 31,072 to Jadwin, et al., the disclosure of which is hereby incorporated by reference.

Upon polymerization, the precipitated block copolymer can be prepared for use as a toner by various methods known in the art. Essentially, the block copolymer is reduced to a particulate form and desired addenda must be added, melt compounded and reground to a size suitable for use as an electrophotographic toner. Particles having an average diameter between about 0.1 micron and about 100 microns are useful in electrographic processes, although present day office copy devices typically employ particles having an average diameter between about 1.0 and 30 microns.

One method of preparing the block copolymer toner is conventional melt-blending. Melt-blending involves melting a crushed form of the block copolymer and mixing it with other necessary or desirable addenda including colorants such as dyes or pigments and charge control agents. The polymer can readily be melted on heated compounding rolls which are also useful to stir or otherwise blend the block copolymer and addenda to promote the complete intermixing of the various ingredients. After thorough blending, the mixture is cooled and solidified. The resultant solid mass is recrushed, coarsely ground, and then finely ground (i.e., pulverized). A variety of techniques can be used in addition to melt-blending. For example, spray-drying or spray-freeze drying techniques can provide useful methods for preparing toner particles. An example of a spray-drying technique can be found in U.S. Pat. No. 2,357,809 to Carlson. Spray-freeze drying is described in Product Licensing Index, volume 84, p. 34–36, April, 1971.

A variety of colorant materials selected from dyes and/or pigments are advantageously employed in the toner materials of the present invention. Colorants serve to color the toner and/or render it more visible. Suitable toner materials having the appropriate charging characteristics can be prepared without the use of a colorant material where it is desired to have a developed image of low optical opacity. In those instances where it is desired to utilize a colorant, the colorants used, can, in principle, be selected from virtually any of the compounds mentioned in the Colour Index, Volumes 1 and 2, Second Edition.

Included among the vast number of useful colorants would be such materials as Hansa Yellow G (C.I. 11680), Nigrosine Spirit soluble (C.I. 50415) Chromogen Black ETOO (C.I. 45170), Solvent Black 3 (C.I. 26150), Fuchsine N. (C.I. 42510), C.I. Basic Blue 9 (C.I. 52015), etc. Carbon black is a particularly useful colorant. The amount of colorant added can vary over a wide range, for example, from about 1 to about 20 percent of the weight of the binder. Particularly good results are obtained when the amount is from about 2 to 10 percent. When no colorant is needed, the lower limit of concentration would be zero.

Charge control agents suitable for use in toners are disclosed, for example, in U.S. Pat. Nos. 3,893,935; 4,079,014; 4,323,634; and British Patent Nos. 1,501,065 and 1,420,839. Charge control agents are generally employed in small quantities, such as from about 0.1 to about 3 weight percent, preferably from about 0.2 to about 1.5 weight percent, based on the weight of the toner.

The block copolymer product of the vinyl polymerization can also be prepared for use as a toner by evaporation limited coalescence processes. The product of the vinyl polymerization (i.e., the block copolymer) is first dissolved in an organic solvent which is immiscible with the suspending medium to be used. The toner addenda (e.g., colorant, charge control agent) can be added to the block copolymer either before or during this solution step.

The quantity of solvent is important in that the size of the particles thus prepared under given agitation conditions influences the size of the powder particles that result. It is generally the case that higher concentrations of block copolymer in the solvent produce larger particle size powder particles having a lower degree of shrinkage than that produced by lower concentrations of block copolymer in the same solvent. The concentration of the block copolymer in the solvent should be from about 1 to about 80 and preferably from about 2 to about 60% by weight. When preparing electrographic toner particles the concentration of block copolymer in solvent is generally maintained at from about 10 to about 35% by weight for a resin having a number average molecular weight of 10,000 and a weight average molecular weight of 200,000.

The block copolymer in the solvent is next introduced into a suspending medium under high shear. The suspending medium is immiscible with the organic solvent and contains a stabilizer and, optionally, a promoter which drives the stabilizer to the interface between the suspending medium and the block copolymer-solvent droplets formed by the agitation conducted on the system. To achieve this effect, it is generally desired to control the pH of the system at a value of from about 2 to about 7, preferably from about 3 to 6 and most preferably 4. The promoter should be present in an amount of about 1 to about 10 percent and preferably from about 2 to about 7 percent based on the weight of the block copolymer and solvent. The size of the droplets formed depends on the shearing action on the system plus the amount of dispersing agent employed. While any high shear type agitation device is applicable to the process of this invention, it is preferred that the block copolymer in solution be introduced into the suspending medium in a microfluidizer such as Model No. 110T produced by Microfluidics Manufacturing. In this device the droplets of block copolymer in solvent are dispersed and reduced in size in the suspending medium in a high shear agitation zone. Upon exiting this zone, the small droplets of the block copolymer in solution are suspended as a discontinuous phase in the continuous suspending medium. Each of the block copolymer-in-solution droplets are surrounded by particles of the solid dipersing agent which limits and controls both the size and size distribution of the block copolymer-solvent droplets.

After exiting the microfluidizer, the particle size of the block copolymer-solvent droplets is established. The small droplets of block copolymer-solvent coalesce to form larger droplets, as limited by the stabilizer on the surface of the small block copolymer-solvent droplets. The solvent is next removed from the droplets by any suitable technique, such as, for example, heating the entire system to vaporize the solvent and thus remove it from the discontinuous phase droplets remaining in the suspension solution surrounded by the stabilizer particles.

Next, should it be desired, the stabilizer can be removed from the surface of the polymer particles by any suitable technique such as dissolving in hydrogen fluoride or other fluoride ion or, preferably, by adding an alkaline agent such as potassium hydroxide to the aqueous phase containing the polymer particles. After dissolving the stabilizer, the polymer particles can be recovered by filtration and finally washed with water or other agents to remove any impurities from the surface of the particles.

Any suitable solvent which will dissolve the polymer and is also immiscible with the suspension medium can be used as the organic solvent in the practice of this invention. For example, chloromethane, dichloromethane, ethyl acetate, methyl ethyl ketone, trichloromethane, carbon tetrachloride, trichloroethane, toluene, xylene, cyclohexanone, 2-nitropropane and the like are all useful solvents. A particularly useful solvent is dichloromethane due to its high volatility rendering it readily removed from the discontinuous phase droplets by evaporation.

Any suitable suspending medium which is immiscible with the solvent can be used in the practice of the present invention. Water is often utilized due to its immiscibility with many useful organic solvents.

The stabilizers useful in evaporation limited coalescence include silica, alumina, barium sulfate, calcium sulfate, barium carbonate, calcium carbonate, and calcium phosphate. The silica-based stabilizers disclosed in U.S. Pat. No. 4,833,060 to Nair, et al. are preferred. A particularly useful silica stabilizer is sold by DuPont under the name Ludox TM. The silicon dioxide particles used as a stabilizer generally should have dimensions from about 0.001 μm to about 1 μm, preferably from about 5 to 35 nanometers and most preferably from about 10–25 nanometers. The size and concentration of these particles controls and predetermines the size of the final toner particle. In general, as the concentration of stabilizer is increased, the size of the coalesced droplets will decrease.

Other preferred stabilizers include the latex-based copolymer stabilizers disclosed in U.S. Pat. No. 4,965,131 to Nair et al. If a latex-based copolymer stabilizer is used, the stabilizer need not be removed from the toner particles and no promoter is required to form the block copolymer toner particles.

Any suitable promoter which is soluble in the suspending medium and affects the hydrophilic/hydrophobic balance of the stabilizer in the suspension medium can be employed in order to drive the solid stabilizer to the interface between the block copolymer-solvent droplet and the suspension medium. Exemplary promoters include sulfonated polystyrenes, alginates, carboxymethyl cellulose, tetramethylammonium hydroxide or chloride, diethylaminoethyl methacrylate, water-soluble complex resinous amine condensation products such as the water soluble condensation products of diethanolamine and adipic acid (a particularly suitable promoter of this type is poly(adipic acid-co-methylaminoethanol)), water-soluble condensation products of ethylene oxide, urea and formaldehyde and polyethyleneimine. Other useful promoters include gelatin, glue, casein, albumin, gluten and the like. Nonionic materials such as methoxy cellulose can be used. Generally, the promoter is used in amounts of from about at least 0.2 and preferably 0.25 to about 0.6 parts per 100 parts of suspension medium.

Particles having an average size of from 0.05 μm to 100 μm and, preferably, from 0.1 μm to 60 μm can be prepared by evaporation limited coalescence. Further details relating to evaporation limited coalescence can be found in U.S. Pat. No. 4,833,060 to Nair et al., and U.S. Pat. No. 4,965,131 to Nair et al., the disclosures of which are hereby incorporated by reference.

The present method also allows advantageous cross-linking of toners prepared by evaporation limited coalescence techiques. Typically, toners prepared by evaporation LC processes are not cross-linked because the cross-linked polymer required in the discontinuous phase will not adequately disperse in currently available dispersants. In this embodiment, a vinyl monomer containing a reactive functional group is polymerized in the presence of a chain transfer polyester according to the present method. The resulting block co-polymer, when dissolved in the dispersant to form the discontinuous phase of the evaporation LC system, can then be cross-linked at the reactive sites by adding an agent which will react with the block copolymer at the reactive sites to provide advantageously cross-linked toner particles. Although it should be noted that this cross-linking may result in the early precipitation of the dissolved block copolymer, the resulting toner particles will have a suitably small particle size as determined by the degree of limited coalescence. Vinyl monomers having reactive functional groups useful in the present embodiment include: vinyl halides (e.g., m+p-vinylbenzyl chloride, p-vinylbenzyl chloride, m+p-(vinylbenzyl)-2-chloroethylsulfone, and the like); vinyl alcohols (e.g., p-vinylbenzyl alcohol, N,N-bis(2-hydroxyethyl)-N'-(alpha, alpha-dimethyl-m-isopropenylbenzyl)urea, N,N-bis(2-hydroxypropyl)-N'-(alpha, alpha-dimethyl-m-isopropenylbenzyl)urea, N-acryloyltris(hydroxymethyl-)aminomethane, and the like); vinyl amines (e.g., 2-aminoethyl methacrylate hydrochloride, N-(3-aminopropyl)methacrylamide hydrochloride, 2-dimethylaminoethyl methacrylate, N-(p-vinylbenzyl)-N,N-dimethylamine, 4-vinylpyridine, 2-vinylpyridine, and the like); and active methylene monomers such as 2-acetoacetoxyethyl methacrylate. Further details regarding this embodiment of the present method are found in Examples 12 and 13, infra.

Alternatively, toners derived from a disulfide-containing chain transfer polyester can be prepared by suspension polymerization, a limited coalescence process disclosed in, for example, U.S. Pat. No. 4,835,084 to Nair et al., the disclosure of which is hereby incorporated by reference. Suspension polymerization includes the steps of dispersing a chain transfer polyester, polymerizable vinyl monomers, and an initiator in a dispersant to form a dispersion phase which is immiscible with the suspending medium. Addenda (e.g., colorants, charge control agents), if added, are also added to this phase. Next, the dispersion phase is introduced to a suspending medium containing a stabilizer and a promotor which drives the stabilizer to the surface of the dispersion phase particles. This mixture is agitated under heavy shearing forces in order to reduce the size of the droplets. During this time, an equilibrium is reached and the size of the droplets is stablized by the action of the colloidal stabilizer in coating the surface of the droplets. Polymerization is then completed by heating and stirring the mixture in an inert atmosphere to a temperature sufficient to activate the initiator and for a time suitable to get a suitably high conversion of vinyl monomer. The vinyl polymerization results in droplets of block copolymer containing polyester blocks and polyvinyl blocks linked by sulfide groups previously constituting the disulfide moiety of the chain transfer polyester. The suspended polymer particles are then collected, by filtration for example, and, optionally, the stabilizer is removed from the surface of the toner particles by dissolving the stabilizer in hydrogen fluoride or another fluoride ion. Preferably, if a silica stabilizer is used, it is removed by adding an alkaline agent (e.g., potassium hydroxide) to the aqueous phase to raise the pH to at least about 12 while stirring the particles. Subsequent to raising the pH and removing the stabilizer, the polymer particles can be recovered by filtration and finally washed with water or other agents to remove any impurities from the surface of the particles. Latex-based copolymer stabilizers, if used, do not require a promoter and need not be removed from the surface of the block copolymer. Further details relating to suspension polymerization are disclosed in U.S. Pat. No. 4,835,084 to Nair et al., and U.S. Pat. No. 4,965,131 to Nair et al.

The toner particles, once formed according to the method of the present invention, can be mixed with a carrier vehicle. The carrier vehicles, used to form suitable developer compositions, are selected from a variety of materials. Such materials include carrier core particles and core particles overcoated with a thin layer of film-forming resin.

The carrier core materials can comprise conductive, non-conductive, magnetic, or non-magnetic materials. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518, 4,478,925, and 4,546,060.

As noted above, the carrier particles can be overcoated with a thin layer of a film-forming resin for the purpose of establishing the correct triboelectric relationship and charge level with the toner employed. Examples of suitable resins are described in U.S. Pat. Nos. 3,547,822, 3,632,512, 3,795,618, 3,898,170, 4,545,060, 4,478,925, 4,076,857, and 3,970,571.

A typical developer composition containing the above-described toner and a carrier vehicle generally comprises from about 1 to about 20 percent, by weight, particulate toner particles and from about 80 to about 99 percent, by weight, carrier particles. Usually, the carrier particles are larger than the toner particles. Conventional carrier particles have a particle size on the order of from about 20 to about 1200 micrometers, generally about 30–300 micrometers.

Alternatively, the toners of the present invention can be used in a single component developer, i.e., with no carrier particles.

The invention will further be illustrated by the following examples.

EXAMPLES

In the Examples below, melting points and boiling points are uncorrected. Inherent viscosities ("IV") were determined in methylene chloride at a concentration of 0.25 g/100 ml of solution. Nuclear Magnetic Resonance ("NMR") spectra were determined with a Varian EM-390, 90 MHz NMR spectrometer, Varian Associates, Palo Alto, Calif. NMR was used extensively to characterize monomers and polymers. Size exclusion chromatography ("SEC") was performed on high performance chromatograph u-styragel columns of $10^6$, $10^5$, $10^4$, and $10^3$ Å porosities, calibrated with monodisperse polysterene standards to determine polymer molecular weights. Results are displayed as polysterene equivalent molecular weights. Differential Scanning Colorimetry ("DSC") was performed to determine glass transition temperatures ("Tg"). Turbidimetric titrations of the block copolymers were performed by preparing 1% solutions in methylene chloride and titrating with methanol. Percent transmittance versus volume of methanol titrant were plotted to determine turbidity end points. Elemental analyses were performed by combustion.

EXAMPLE 1

Synthesis of bis(4-carboxyphenyl) disulfide

A solution of 69.0 g (1.0 mole) of sodium nitrite in 280 ml of water was added in portions to a cold (0°–5° C.) mixture of 137.0 g (1.0 mole) of p-aminobenzoic acid in 500 ml of water and 200 ml of concentrated hydrochloric acid ("HCl"), keeping the reaction temperature below 5° C. This mixture was then added in portions to a previously prepared solution of 260.0 g (1.1 mole) of $Na_2S.9H_2O$, 34.0 g of powdered sulfur and 290 ml of water to which was added a solution of 40.0 g (1.0 mole) of sodium hydroxide in 200 ml of water. After addition of the diazonium salt was complete, the mixture was stirred and slowly allowed to come to room temperature. Nitrogen was evolved and the resultant foaming was controlled by the addition of ice and ether. 180 ml of concentrated HCl was then added and the mixture was filtered. The solids were washed with water, dissolved in a solution of 120 g of sodium carbonate in 2.0 liters of water, filtered, and acidified with concentrated HCl. The solid was collected, washed with water, and dried. The yield of bis(4-carboxyphenyl) disulfide was 123.0 g and had a melting point ("mp") of 315°–325° C.

EXAMPLE 2

Synthesis of bis(4-carbomethoxyphenyl) disulfide

A mixture of 123.0g (0.402 mol) of bis(4-carboxyphenyl) disulfide and 1 liter of methanol was saturated with HCl gas and heated at reflux for 1 hour, intermittently adding more HCl gas. 1 liter of methanol was added and reflux was continued for another 2.5 hours while adding HCl gas. Most of the acid had been esterified by this time. The hot mixture was filtered and cooled. The solid which crystallized was collected, dissolved in methylene chloride, treated with decolorizing carbon and concentrated. The residue was recrystallized from acetonitrile to give 28.5 g of bis(4-carbomethoxyphenyl) disulfide having amp of 123.5°–124.5° C.

EXAMPLE 3

Synthesis of 2,2'-dithio(dibenzoyl chloride)

A mixture of 150.0 g (0.487 mol) of dithiosalicylic acid, 750 ml of thionyl chloride and 5 ml of N,N-dimethylformamide ("DMF") was heated at reflux for 2 hours and concentrated. The residue was washed with ligroine (bp of 35°–60° C.) and recrystallized from toluene, collected, washed with ligroine (bp of 35°–60° C.) and dried. The yield of 2,2'-dithio(dibenzoyl chloride) was 97.5 g and had amp of 156°–158° C.

EXAMPLE 4

Synthesis of bis(2-carbomethoxyphenyl) disulfide

A mixture of 5.0 g (0.0162 mol) of 2,2'-dithio(dibenzoyl chloride) and 50 ml of methanol was heated at reflux for 25 minutes and cooled. The solid was collected and dried to give 4.9 g of bis(2-carbomethoxyphenyl) disulfide having amp of 130°–32° C.

EXAMPLE 5

Synthesis of dimethyl 4,4'-dithiodibutyrate

A solution of 100.0 g (0.42 mol) of 4,4'-dithiodibutyric acid, 1 liter of methanol and 10 drops of concentrated sulfuric acid was heated at reflux for 30 minutes and allowed to cool overnight. The solution was heated for 30 minutes again and concentrated. The residual oil was dissolved in methylene chloride, washed twice with dilute sodium bicarbonate, once with water, dried over $MgSO_4$ and concentrated. The oily residue was distilled to give 74.5 g of dimethyl 4,4'-dithiodibutyrate having a boiling point ("bp") of 172°–174° C. at a pressure of 0.8 mm Hg.

EXAMPLE 6

Synthesis of bis(4-chlorocarbonylphenyl) disulfide

Bis(4-carbomethoxyphenyl) disulfide prepared according to Example 2 was saponified to form bis(4-carboxyphenyl) disulfide. 8.9 g (0.029 mol) of bis(4-carboxyphenyl) disulfide was heated at reflux in a mixture of 50 ml of thionyl chloride and 2 drops of DMF for 30 minutes. The resultant solution was concentrated, treated with ligroine (bp of 35°–60° C.), concentrated again and allowed to stand in heptanes for two days. The initial oil crystallized and was taken up in methylene chloride, filtered, concentrated and recrystallized from heptanes. The yield of bis(4-chlorocarbonylphenyl) disulfide was 2.7 g and had amp of 66°–68° C.

EXAMPLE 7

Synthesis of bis(4-isocyanatophenyl) disulfide

A mixture of 248.4 g (1.0 mol) of bis(4-aminophenyl) disulfide, 200.0 g (2.0 mol) of concentrated HCl and 400 ml of water was heated to boiling, treated with decolorizing carbon and filtered. The filtrate was cooled and the solid was collected, washed with acetone and then with ether and dried. The yield of bis(4-aminophenyl) disulfide dihydrochloride was 139.0 g.

A solution of 407.5 g (0.618 mol) of 15% phosgene in toluene was added dropwise to a mixture of 40.0 g (0.125 mol) of bis(4-aminophenyl) disulfide dihydrochloride in 150 ml of toluene while heating on a steam bath over 2 hours. Heating was continued for another 5 hours and then nitrogen was swept through the reaction mixture overnight. The mixture was filtered and the filtrate was concentrated to an oil. Ligroine (bp of 35°–60° C.) was added to crystallize the oil. The solid was collected, recrystallized from hexanes, collected and dried. The yield of bis(4-isocyanatophenyl) disulfide was 5.6 g and had amp of 60°–62° C. A second yield of 13.0 g was obtained from the filtrate on concentrating to dryness which had amp of 61°–63° C.

EXAMPLE 8

Synthesis of
N,N'-bis(4-carbomethoxybenzoyl)-N,N'-dithiodianiline 19.9 g (0.10 mol) of 4-carbomethoxybenzoyl chloride was added in portions to a solution of 12.4 g (0.05 mol) of 4,4'-dithiodianiline in 300 ml of pyridine and stirred for 1 hour at room temperature. The reaction mixture was poured into water and the precipitate was filtered, washed with water and recrystallized from DMF. The crystals were collected, washed with methanol and then with ether. The yield of N,N'-bis(4-carbomethoxybenzoyl)-N,N'-dithiodianiline was 28.0 g and had a mp of 276°–278° C.

EXAMPLE 9

Synthesis of bis(2-hydroxymethylphenyl) disulfide

A solution of 30.8 g (0.20 mol) of o-mercaptobenzoic acid in 300 ml of dioxane was added to a mixture of 15.2 g (0.40 mol) lithium aluminum hydride in 300 ml of dioxane. 160 ml of tetrahydrofuran ("THF") was slowly added to this mixture with some loss of material due to bumping. The mixture was stirred for 2 hours followed by the slow addition of 15.2 ml of water, then 15.2 ml of 15% NaOH and finally 45.6 ml of water. The mixture was filtered with a methanol wash and the filtrate was concentrated to 20.0 g of oil. Methanol (250 ml) and 18.1 g (0.07 mol) of iodine were added and the mixture was stirred over the weekend. An equal volume of saturated NaCl solution was added and the solid was collected, washed with water, and recrystallized from aqueous ethanol. The yield of bis(2-hydroxymethylphenyl) disulfide was 10.0 g and had amp of 138.5°–139.5° C.

EXAMPLE 10

Determination of Chain Transfer Constants

The chain transfer constants of the disulfides prepared in Examples 2, 4 and 5 were determined by the bulk polymerization of styrene with varying concentrations of disulfide. A plot was made of the reciprocal of the degree of polymerization of the resultant polystyrene (determined by SEC) versus the molar ratio of disulfide concentration to styrene monomer concentration. The slope of the resultant line provides the chain transfer constant according to the Mayo equation. The Mayo equation is an integrated expression valid for instantaneous polymerization events. To maintain a constant molar ratio of disulfide concentration to styrene monomer concentration (and maintain the accuracy of the Mayo Equation), polymers must be prepared at low conversions. "Conversion" is a percentage equal to the yield of polymer divided by the total of the weight of the monomer plus the weight of the chain transfer agent × 100.

The Mayo equation is shown by equation I below:

$$1/DP = 1/DP^{\circ} + C_T[[S—S]/[M]) \quad (I)$$

where

DP = degree of polymerization

DP° = degree of polymerization in absence of chain transfer agent $C_T$ = chain transfer constant

[S—S] = disulfide concentration

[M] = styrene monomer concentration 20.0 g of styrene, 0.020 g of azobisisobutyronitrile ("AIBN") and varying quantities (0.100, 0.200 or 0.300 g) of bis(4-carbomethoxyphenyl) disulfide, bis(2-carbomethoxyphenyl) disulfide, or dimethyl 4,4'-dithiodibutyrate were weighed into an 8 dram vial, purged with nitrogen for 15 minutes and sealed. The vials were heated in a 50° C. bath for 3.25–3.50 hours and poured into 400 ml of methanol. The polymer was collected and dried in a 50° C. vacuum oven. Polystyrene equivalent molecular weights were determined by size exclusion chromatography. Data from these experiments are compiled in Table I, where A is bis(4-carbomethoxyphenyl) disulfide; B is bis(2-carbomethoxyphenyl) disulfide; and C is dimethyl 4,4'-dithiodibutyrate.

TABLE I

| DISULFIDE | [S—S] [mol/L] × $10^3$ | [M] [mol/L] | [S—S]/[M] × $10^3$ | CONVERSION % | Mn | DP | 1/DP × $10^3$ |
|---|---|---|---|---|---|---|---|
| A | 0.00 | 8.71 | 0.00 | 4.2 | 208220 | 1999 | 0.500 |
| A | 13.56 | 8.71 | 1.557 | 2.7 | 134180 | 1288 | 0.776 |
| A | 27.12 | 8.71 | 3.114 | 2.6 | 90260 | 866 | 1.155 |
| A | 40.68 | 8.71 | 4.671 | 2.6 | 72030 | 691 | 1.447 |
| B | 0.00 | 8.71 | 0.00 | 4.2 | 208220 | 1999 | 0.500 |
| B | 13.56 | 8.71 | 1.557 | 2.9 | 171810 | 1650 | 0.606 |
| B | 27.12 | 8.71 | 3.114 | 2.6 | 152780 | 1467 | 0.692 |
| B | 40.68 | 8.71 | 4.671 | 2.3 | 149470 | 1435 | 0.697 |
| C | 0.00 | 8.71 | 0.00 | 4.2 | 208220 | 1999 | 0.500 |
| C | 17.07 | 8.71 | 1.953 | 4.2 | 158640 | 1523 | 0.657 |
| C | 34.06 | 8.71 | 3.911 | 4.0 | 162020 | 1556 | 0.643 |
| C | 51.07 | 8.71 | 5.860 | 4.3 | 141610 | 1360 | 0.735 |

wherein:

[S—S] = disulfide concentration

[M] = styrene monomer concentration

Conversion = [(yield of polymer)/(total weight of monomer + disulfide)] × 100

Mn = number average polystyrene equivalent molecular weight

DP = degree of polymerization

A plot of 1/DP vs. [S—S]/[M] shows that bis(4-carbomethoxyphenyl) disulfide was the most active with a chain transfer constant of 0.207. In determining this value, it was assumed that no volume changes occurred when the disulfide was dissolved in the styrene monomer.

The chain transfer constants of bis(2-carbomethoxyphenyl) disulfide and dimethyl 4,4'-dithiodibutyrate were 0.043 and 0.035 respectively. The foregoing indicate that A is most effective in chain transfer activity leading to the lowest molecular weight of polystyrene.

EXAMPLE 11

Synthesis of Chain Transfer Polyesters

Syntheses of chain transfer polyesters were conducted by the following representative procedure for the 5 mole percent case using bis(4-carbomethoxy)phenyl disulfide (Sample 4).

A 500 ml polymer flask was charged with 92.2 g (0.475 mol) of dimethyl terephthalate ("DMT"), 8.36 g (0.025 mol) of bis(4-carbomethoxyphenyl) disulfide and 72.9 g (0.70 mol) of neopentyl glycol ("NPG"). The flask was equipped with a Vigreax-Claisen head and nitrogen inlet tube and the side arm of the flask was sealed. The monomer mixture was melted in a 200° C. bath and 5 drops of tetraisopropyl orthotitanate ($Ti(OPr)_4$) were added. The mixture was then heated at 220° C. for 2 hours at which time the bath temperature was raised to 240° C. The mixture was heated for 1 hour and the column was removed. After another hour of heating at 240° C., a metal blade stirrer was introduced and the pressure was reduced to 0.30 mm. Heating and stirring were continued for 2.25 hours after which the polymer poly[2,2-dimethyl-1,3- propylene terephthalate co 4,4'-dithiodibenzoate (95:5)] was cooled and isolated.

The experimental details regarding the chain transfer polyesters produced and their properties are listed in Tables II and III below.

TABLE II

| SAMPLE # | S—S* | S—S Amt. (moles) | DMT Amt. (moles) | NPG Amt. (moles) | $Ti(OPr)_4$ Amt. (drops) |
|---|---|---|---|---|---|
| 1 | — | — | 0.72 | 1.26 | ** |
| 2 | A | 0.009 | 0.891 | 1.30 | 9 |
| 3 | B | 0.018 | 1.782 | 2.60 | 18 |
| 4 | A | 0.025 | 0.475 | 0.70 | 5 |
| 5 | A | 0.050 | 0.450 | 0.70 | 5 |

*S—S = disulfide used in sample [A = bis(4-carbomethoxyphenyl) disulfide, B = bis(2-carbomethoxyphenyl) disulfide]

**Sample 1 catalyst was a combination of 0.0763 g $An(OAc)_2 \cdot 2H_2O$ and 0.139 g of $Sb_2O_3$

TABLE III

| SAMPLE # | X | S—S | Tg °C. | IV (DCM) | Mn | Mw | Mw/Mn |
|---|---|---|---|---|---|---|---|
| 1 | 0 | — | 74 | 0.33 | 13245 | 31319 | 2.36 |
| 2 | 1 | A | 74 | 0.30 | 12235 | 27939 | 2.28 |
| 3 | 1 | B | 73 | 0.33 | 11329 | 26093 | 2.30 |
| 4 | 5 | A | 74 | 0.37 | 11046 | 29554 | 2.68 |

TABLE III-continued

| SAMPLE # | X | S—S | Tg °C. | IV (DCM) | Mn | Mw | Mw/Mn |
|---|---|---|---|---|---|---|---|
| 5 | 10 | A | 74 | 0.33 | 8479 | 22944 | 2.70 |

wherein

X=mole percent disulfide

Tg=glass transition temperature

IV=inherent viscosity

Mn=number average polystyrene equivalent molecular weight

Mw=weight average polystyrene equivalent molecular weight

S—S=Disulfide used in sample

EXAMPLE 12

Polymerization of Vinyl Monomers in the Presence of Chain Transfer Polyesters Vinyl monomers were polymerized in the presence of various chain transfer polyesters according to the following general procedure. A solution of chain transfer polyester (the specific polyester used for each sample is listed below) in THF was prepared in a flask at 60° C. A quantity of vinyl monomer was added to this solution and the solution was purged with nitrogen. A quantity of AIBN was added and the solution was stirred under nitrogen for 16–25 hours (the flasks were sealed in Samples 1, 2, 4, 6, 8). The resultant mixture was poured into cyclohexane (Samples 2, 6, 8) or methanol (Samples 1, 3–5, 7) to precipitate polymer which was then dried. Samples 1–7 were dissolved in methylene chloride and reprecipitated in cyclohexane, collected, washed with ligroine, cyclohexane, or heptanes and dried.

The chain transfer polyesters (CT) used in each sample are as follows:

Sample 1—Poly[2,2-dimethyl-1,3-propylene terephthalate]

Sample 2—Poly[2,2-dimethyl-1,3-propylene terephthalate co-4,4'-dithiodibenzoate (99:1)]

Sample 3—Poly[2,2-dimethyl-1,3-propylene terephthalate co-4,4'-dithiodibenzoate (95:5)]

Sample 4—Poly[2,2-dimethyl-1,3-propylene terephthalate co-4,4'-dithiodibenzoate (90:10)]

Sample 5—Poly[2,2-dimethyl-1,3-propylene terephthalate co-4,4'-dithiodibenzoate (95:5)]

Sample 6—Poly[2,2-dimethyl-1,3-propylene terephthalate co-4,4'-dithiodibenzoate (99:1)]

Sample 7—Poly[2,2-dimethyl-1,3-propylene terephthalate co-4,4'-dithiodibenzoate (95:5)]

Sample 8—Poly[2,2-dimethyl-1,3-propylene terephthalate co-4,4'-dithiodibenzoate (95:5)]

The vinyl monomers ("M") were either styrene (S), a mix of m+p-chloromethylstyrene (ClS), butyl acrylate (BuA), or a combination of 75% styrene and 25% butyl acrylate (SBu). The reaction for this example is illustrated as reaction II below, where x and y are the mole percents of each diacid moiety. x plus y equals 100. z is the mole percent of vinyl monomer M in the block coplolymer.

(II)

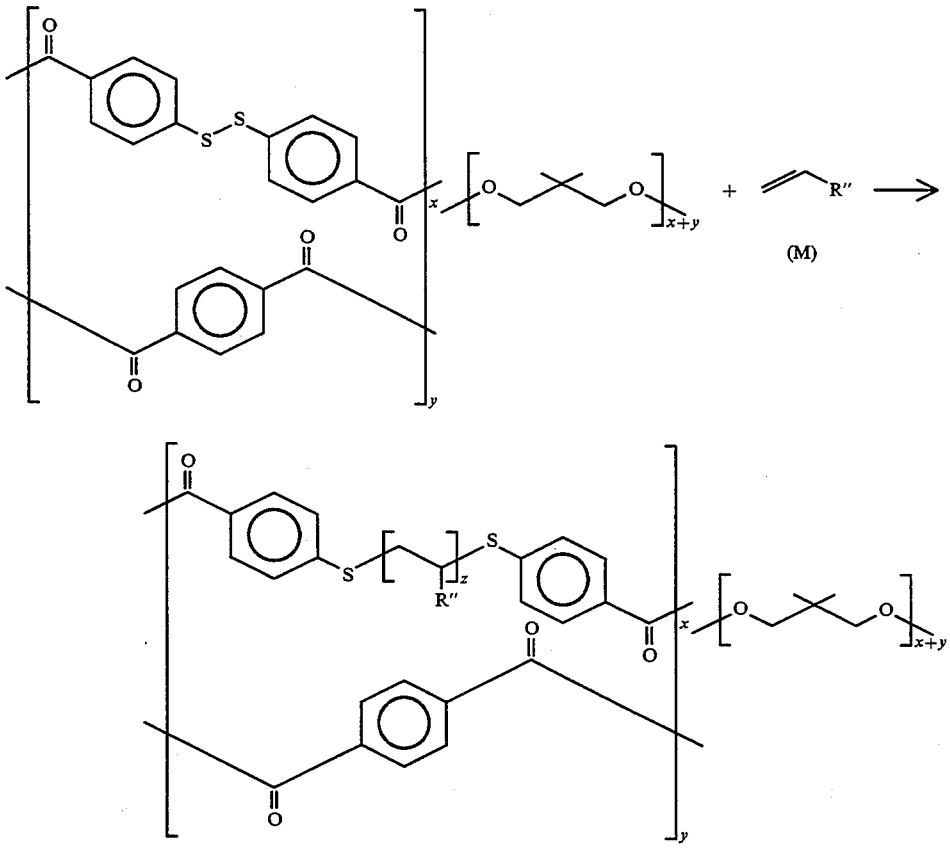

The procedural details of Samples 1–8 are listed in Table IV below. The properties of the resulting block copolymers are listed in Table V below.

TABLE IV

| Sample | M | x | y | CT (g) | M (g) | AIBN (g) | THF (ml) | Time (hrs) | CONV (%) |
|---|---|---|---|---|---|---|---|---|---|
| 1 | S | 0 | 100 | 25 | 25 | 0.125 | 200 | 25 | 47.1 |
| 2 | S | 1 | 99 | 25 | 25 | 0.125 | 125 | 21 | 46.4 |
| 3 | S | 5 | 95 | 25 | 25 | 0.125 | 125 | 21 | 40.4 |
| 4 | S | 10 | 90 | 25 | 25 | 0.125 | 125 | 23 | 45.4 |
| 5 | S | 5 | 95 | 10 | 40 | 0.200 | 125 | 24 | 18.4 |
| 6 | ClS | 1 | 99 | 25 | 25 | 0.125 | 125 | 16 | 60.0 |
| 7 | BuA | 5 | 95 | 25 | 25 | 0.125 | 125 | 22 | 32.0 |
| 8 | SBu | 5 | 95 | 25 | 25 | 0.125 | 150 | 19 | 40.0 |

TABLE V

| Sample | IV (DCM) | Tg °C. | z (Mole %) | Mn | Mw | Mw/Mn |
|---|---|---|---|---|---|---|
| 1 | 0.30 | 73 | 2.7 | 20219 | 32811 | 1.62 |
| 2 | 0.36 | 74 | 19.8 | 18517 | 30822 | 1.66 |
| 3 | 0.34 | 69 | 25.3 | 20137 | 35434 | 1.76 |
| 4 | 0.34 | 64 | 19.9 | 15031 | 28378 | 1.89 |
| 5 | 0.28 | 78 | 44.4 | 15396 | 30976 | 2.01 |
| 6 | 0.33 | 75 | 33.3 | 16462 | 29130 | 1.77 |
| 7 | 0.44 | 79 | 44.0 | 17247 | 33023 | 1.91 |
| 8 | 0.42 | 74 | 16.7* | 20079 | 36166 | 1.80 |

*equal molar ratios

Table V illustrates the incorporation of polyvinyl blocks into chain transfer polyesters. A comparison of Sample 1 (no chain transfer agent present) with Samples 2–8 (chain transfer agent present) indicates that significantly more polyvinyl incorporation occurs in the presence of chain transfer polyester. In addition turbidimetric titrations of these block copolymers show that they precipitate with volumes of titrant between that for pure polyvinyl and pure chain transfer polyester, indicating the polyvinyl blocks were incorporated into the chain transfer polyester.

EXAMPLE 13

Crosslinking of Vinylbenzyl Chloride Block Copolymer Sample 6 of Table V

A solution of 2.0 g of the block copolymer of Sample 6 of Table V was prepared with 20 ml of methylene chloride. Several drops of 1,4-bis(aminomethyl)cyclohexane were added and the solution was allowed to stand in a stoppered flask over night. The solution became hazy and viscous and eventually formed a gel indicating crosslinking of the block copolymer (which contains pendant benzyl chloride) by alkylation of the added diamino compound.

EXAMPLE 14

Synthesis of hydroxy-terminated poly(2,2-dimethyl-1,3-propylene terephthalate)

A mixture of 501.4 g (4.814 mol) of neopentyl glycol, 636.5 g (3.831 mol) of terephthalic acid and 1.0 g of butyl stannoic acid was heated in a 3-neck, 2 liter flask with metal blade stirrer, nitrogen inlet, thermocouple and partial condensing steam heated column from 150° C. to 210° C. over 20 minutes. Heating at 210° C. was continued for 16.5 hours during which time 129 ml of distillate was collected. The temperature was raised to 235° C. and maintained for 7 more hours to collect a total of 130 ml of distillate. The resin, poly(2,2-dimethyl-1,3-propylene terephthalate) was then poured out and cooled. The resin exhibited the following properties:

IV(DCM)=0.06
Tg=44° C.
$CO_2H$=0.10 meq/g
OH=1.73 meq/g
Mn=3082
Mw=4278
Mw/Mn=1.39

This hydroxy terminated polyester was chain extended according to Example 15.

EXAMPLE 15

Chain Extension of poly(2,2-dimethyl-1,3-propylene terephthalate) Polyester of Example 14 with bis(4-isocyanatophenyl) disulfide 25.0 g (43.23 meq) (polyester of Example 14) of Poly(2,2-dimethyl-1,3-propylene terephthalate) was dried at 100° C. with high vacuum and stirring. 75.0 g of DMF was added to dissolve the polymer under nitrogen. 6.49 g (43.23 meq) of bis(4-isocyanatophenyl) disulfide was added and the solution was stirred for 1 hour at 100° C. under nitrogen. The solution which became more viscous was cooled and poured into methanol to precipitate the polyester-polyurethane. The polymer was rinsed several times with methanol, redissolved in methylene chloride and reprecipitated into methanol. The polymer was rinsed several times with methanol and dried. The yield of polymer was 27.6 g. The polymer exhibited the following properties:

IV(DCM)=0.19
Tg=81° C.
Mn=9289
Mw=23481
Mw/Mn=2.53

As shown by this Example, the hydroxy terminated polyester of Example 14 was chain extended with the diisocyanate disulfide. This provides another route to introduce the chain transfer moiety into a polyester under advantageously mild conditions. The Mn and Mw indicate that the molecular weight of the polyester was substantially increased compared to the polyester of Example 14. Also the Tg increased significantly compared to the polyester of Example 14. This material was used in Example 16 to prepare a polyvinyl-polyester-polyurethane block copolymer.

EXAMPLE 16

Polymerization of Styrene in the Presence of Chain Transfer Polyester-polyurethane of Example 15

A solution of 12.5 g of the chain transfer polyester-polyurethane of Example 15, 12.5 g of styrene and 100 g of THF was purged with nitrogen. AIBN (0.0625 g) was added and the solution was stirred under a positive pressure of nitrogen in a 60° C. bath for approximately 20 hours. During this time the THF evaporated and the polymer was redissolved in THF. The solution was poured into cyclohexane to precipitate the block copolymer which was redissolved in methylene chloride and reprecipitated in cyclohexane. The polymer was rinsed with cyclohexane and dried to give 11.6 g of polyvinyl-polyester-polyurethane block copolymer. The polymer exhibited the following properties:

IV(DCM)=0.21
Tg=74° C.
Mn=16145
Mw=24554
Mw/Mn=1.52
Mole percent styrene by NMR=31.8.

Inclusion of styrene was verified by NMR (31.8 mole %).

EXAMPLE 17

Synthesis of Poly[1,2-propylene terephthalate co-glutarate-co-4,4-dithiodibenzoate(80:15:5)]

A 250 ml polymer flask was charged with 77.7 g (0.40 mol) of dimethyl terephthalate, 8.36 g (0.025 mol) of bis(4-carbomethoxyphenyl) disulfide, 12.0 g (0.075 mol) of dimethyl glutarate, 53.3 g (0.70 mol) of 1,2-propanediol and catalytic amounts of $Zn(OAc)_2.2H_2O$ and $Sb_2O_3$. The flask was equipped with a Vigreax-Claisen head and nitrogen inlet and was heated in a 180° C. bath for 1 hour, 190° C. for 1 hour, and 200° C. for 1 hour. The head was removed and heating was continued for 1 hour at 200° C. A metal blade stirrer was introduced and the melt was stirred at 200° C. for 2 hours at 0.20 mm. The resultant polymer exhibited the following properties:

IV(DCM)=0.09
Tg=41° C.
Mn=3685
Mw=5290
Mw/Mn=1.44

This polymer was used as the chain transfer polyester in Example 18.

EXAMPLE 18

Preparation of a Block Copolymer by Limited Coalescence from the Chain Transfer Polyester of Example 17, Styrene, and Butyl Acrylate A solution of 4.0 g of Example 17 chain transfer polyester, 12.0 g of styrene, 4.0 g of butyl acrylate and 0.48 g of AIBN was added to an aqueous phase consisting of 60 ml of pH 4 buffer, 1.0 ml of LUDOX TM silica, 0.3 ml of 10% promoter and 0.6 ml of 2.5% potassium dichromate while stirring with a Polytron mixer manufactured by Brinkmann. This mixture was then passed through a Microfluidizer and stirred in a 60° C. bath for 24 hours under a positive nitrogen pressure. The suspension was stirred at room temperature over the weekend, collected, stirred with 5.61% KOH then with 0.561% KOH and washed with water several times and dried.

This example demonstrates a method of preparing block copolymer by the limited coalescence method without toner addenda (pigment or charge agent). NMR showed incorporation of styrene and butyl acrylate. Turbidimetric titration showed incorporation of styrene/butyl acrylate as a block and not a mixture.

EXAMPLE 19

Preparation of Toners by Limited Coalescence (Polymerization of Styrene, Butyl Acrylate, 4-Vinylpyridine and Divinylbenzene with Chain Transfer Polyester of Example 17)

Two toners were prepared as described in Example 18 except aluminum phthalocyanine pigment and other addenda were also added. The organic phase of the limited coalescence system consisted of:

1. A dispersion of:
   (a) aluminum phthalocyanine (a pigment),
   (b) KRATON G1652 TM (a stabilizer triblock polymer, styrene/ethylenebutylene/styrene, available from Shell Chemical Company),
   (c) Sr El (a stabilizer copolymer, t-butyl styrene/lithium methacrylate),
   (d) a monomer mixture of S (styrene), B (butyl acrylate) and $V_4$(4-vinylpyridine, a charge control agent) in a ratio of 74:21.6:4, and
   (e) the chain transfer polyester of Example 17 ("CTP");
2. Divinyl benzene (cross linking agent); and
3. VAZO-52 TM (azobisdimethylvaleronitrile free radical initiator available from DuPont).

The compositions of the organic and aqueous phases are listed below:

| | A | B |
|---|---|---|
| Organic Phase | | |
| Dispersion | 36.9 g | 45.2 g |
| Aluminum Phthalocyanine | 6 pph | 6 pph |
| KRATON-G1652 TM | 3 pph | 3 pph |
| SrEl | 1.5 pph | 1.5 pph |
| S/B/V4 | 49.5 pph | 69.5 pph |
| CTP | 40 pph | 20 pph |
| Divinyl benzene | 0.37 g | 0.63 g |
| VAZO-52 TM | 0.56 g | 0.95 g |
| Aqueous Phase | | |
| pH 4 Buffer | 111 ml | 135 ml |
| LUDOX TM | 1.85 ml | 2.25 ml |
| Promoter | 0.56 ml | 0.68 ml |
| 2.5% $K_2Cr_2O_7$ | 1.1 ml | 1.35 ml |

Particles having volume average particle sizes of 6.6 μm (A) and 6.9 μm (B) were obtained. The resultant toner particles exhibited high charge and low throw-offs. Images were successfully made from the resultant particles and oven fused.

This invention has been described in detail with particular reference to preferred embodiments thereof, but it will be understood that variations and modifications can be effected within the spirit and scope of the invention.

What is claimed is:

1. A method of making polymeric toner particles comprising the steps of:

heating a diacid and a diol under conditions effective to form a chain transfer polyester, wherein either said diacid or said diol contain a disulfide moiety;

reacting one or more vinyl monomers with said chain transfer polyester in the presence of an initiator under conditions effective to produce a block copolymer having polyester blocks and polyvinyl blocks, wherein said polyester blocks and said polyvinyl blocks are linked together by a sulfide group previously constituting the disulfide moiety; and reducing said block copolymer to a particulate form to a size suitable for use as an electrographic toner.

2. A method of making polymeric toner particles according to claim 1, wherein the conditions effective to form a chain-transfer polyester comprise heating the diacid and the diol in the presence of a catalyst in an inert atmosphere at about 180° C. to about 280° C., and applying a vacuum at about 200° C. to about 280° C. to increase the molecular weight of said chain transfer polyester and to remove excess diol.

3. A method of making polymeric toner particles according to claim 1, wherein:

said diacid is chosen from the group consisting of sebacic acid, 1,4-cyclohexanedicarboxylic acid, adipic acid, glutaric acid, succinic acid, carbonic acid, oxalic acid, azelaic acid, 4-cyclohexane-1,2-dicarboxylic acid, 2-ethylsuberic acid, 2,2,3,3-tetramethylsuccinic acid, 4,4'-bicyclohexyldicarboxylic acid, terephthalic acid, isophthalic acid, dibenzoic acid, bis(p-carboxyphenyl)methane, 2,6-naphthalenedicarboxylic acid, phenanthrene dicarboxylic acid, and 4,4'-sulfonyldibenzoic acid; and said diol is chosen from the group consisting of bis(-gamma-hydroxypropyl) disulfide, bis(6-hydroxyhexyl) disulfide, bis(6-hydroxy-2-naphthyl) disulfide, bis(4-hydroxyphenyl) disulfide, bis(4-hydroxymethylphenyl) disulfide, bis(2-hydroxymethylphenyl) disulfide, bis(4-(beta-hydroxyethyl)phenyl) disulfide, and bis(3-(beta-hydroxyethyl)phenyl) disulfide.

4. A method of making polymeric toner particles according to claim 1, wherein:

said diacid is chosen from the group consisting of bis(4-carboxyphenyl) disulfide, bis(4-carbomethoxyphenyl) disulfide, 2,2'-dithio(dibenzoyl chloride), bis(4-chlorocarbonylphenyl) disulfide, dimethyl 4,4'-dithiodibutyrate, N,N'-bis(4-carbomethoxybenzoyl)-4,4'-dithiodianiline, bis(3-carboxyphenyl) disulfide, bis(2-carboxyphenyl) disulfide, 2,3'-dicarboxydiphenyl disulfide, 2,4'-dicarboxydiphenyl disulfide, 3,4'-dicarboxydiphenyl disulfide, bis(4-carboxymethylphenyl) disulfide, bis(3-carboxymethylphenyl) disulfide, bis(2-carboxymethylphenyl) disulfide, bis(10-carboxy-n-decyl) disulfide, 3,3'-dithiodipropionic acid, N,N'-bis(beta-carboxypropionyl)-4,4'-dithiodianiline, N,N'-bis(-gamma-carboxybutyryl)-2,2'-dithiodianiline, bis(3-carboxy-1-methylpropyl) disulfide, bis(2,3-dimethoxy-6-carboxyphenyl) disulfide, bis(4-carboxy-methoxyphenyl) disulfides and diisocyanate disulfides; and said diol is chosen from the group consisting of ethylene glycol, diethylene glycol, triethylene glycol, 1,3-propanediol, 1,2-propanediol, 1,4-butanediol, 2-methyl-1,5-pentanediol, 1,4-cyclohexanedimethanol, 1,4-bis($\beta$-hydroxyethoxy)cyclohexane, norcamphanediols, 2,2,4,4-tetraalkylcyclobutane-1,3-diols, p-xylene glycol, neopentyl glycol, hydroquinone, 4,4'-isopropylidenediphenol, and hydroxy-terminated polyesters.

5. A method of making polymeric toner particles according to claim 1, wherein said vinyl monomer is chosen from the group consisting of substituted and unsubstituted styrenes, vinyl naphthalene, ethylenically unsaturated mono-olefins, vinyl halides, vinyl esters, esters of alpha-methylene aliphatic monocarboxylic acids, acrylonitrile, methacrylonitrile, acrylamide, vinyl ethers, vinyl ketones, vinylidene halides, N-vinyl compounds, and mixtures thereof.

6. A method of making polymeric toner particles according to claim 1, further comprising the step of adding a polyfunctional modifier to the diol and the diacid in said heating, wherein said polyfunctional modifier is selected from the group consisting of polyols having three or more hydroxy groups, polycarboxylic acids having three or more carboxylic acid groups, hydroxy acids having three or more total hydroxy and carboxyl groups, and trifunctional and tetrafunctional disulfides.

7. A method of making polymeric toner particles according to claim 1, further comprising the step of adding a crosslinking agent to the vinyl monomer and the chain transfer polyester in said reacting, wherein said crosslinking agent is chosen from the group consisting of aliphatic and aromatic divinyl compounds, diacrylates, dimethacrylates, diacrylamides, and dimethacrylamides.

8. A method of making polymeric toner particles according to claim 1, wherein said initiator is chosen from the group consisting of 2,2'-azobis(dimethyl valeronitrile), azobisisobutyronitrile, lauroyl peroxide, and azobismethylethylacetonitrile.

9. A method of making polymeric toner particles according to claim 1, wherein said reducing comprises the steps of:

crushing said block copolymer;

melt blending said crushed block copolymer with addenda;

recrushing and coarse grinding said melt blended block copolymer;

pulverizing said recrushed and ground block copolymer to a particulate form to a size suitable for use as an electrographic toner.

10. A method of making polymeric toner particles according to claim 9, wherein said addenda are chosen from the group consisting of colorants and charge-control agents.

11. A method of making polymeric toner particles according to claim 1, further comprising the step of mixing said particulate block copolymer with solid carrier particles to form a two-component developer.

12. A method of making polymeric toner particles according to claim 1, wherein said reducing comprises the steps of:

dissolving said block copolymer in an organic solvent to form an organic phase;

dispersing a stabilizer, a buffering agent, and a promoter in water to form an aqueous phase;

mixing said organic phase with said aqueous phase to form a suspension of small droplets of said organic phase in said aqueous phase; and removing said solvent from said droplets to form solidified polymeric toner particles.

13. A method of making polymeric toner particles according to claim 12, wherein the conditions effective to form a chain-transfer polyester comprise heating the dicarboxylic acid and the glycol in the presence of a catalyst in an inert atmosphere at about 180° C. to about 280° C., and applying a vacuum at about 200° C. to about 280° C. to increase the molecular weight of said chain transfer polyester and to remove excess glycol.

14. A method of making polymeric toner particles according to claim 12, wherein:

said diacid is chosen from the group consisting of sebacic acid, 1,4-cyclohexanedicarboxylic acid, adipic acid, glutaric acid, succinic acid, carbonic acid, oxalic acid, azelaic acid, 4-cyclohexane-1,2-dicarboxylic acid, 2-ethylsuberic acid, 2,2,3,3-tetramethylsuccinic acid, 4,4'-bicyclohexyldicarboxylic acid, terephthalic acid, isophthalic acid, dibenzoic acid, bis(p-carboxyphenyl)methane, 2,6-naphthalenedicarboxylic acid, phenanthrene dicarboxylic acid, and 4,4'-sulfonyldibenzoic acid; and said diol is chosen from the group consisting of bis(-gamma-hydroxypropyl) disulfide, bis(6-hydroxyhexyl) disulfide, bis(6-hydroxy-2-naphthyl) disulfide, bis(4-hydroxyphenyl) disulfide, bis(4-hydroxymethylphenyl ) disulfide, bis(2-hydroxymethylphenyl ) disulfide, bis(4-(beta-hydroxyethyl) phenyl) disulfide, and bis(3-(beta-hydroxyethyl) phenyl) disulfide.

15. A method of making polymeric toner particles according to claim 12, wherein:

said diacid is chosen from the group consisting of bis(4-carboxyphenyl) disulfide, bis(4-carbomethoxyphenyl) disulfide, 2,2'-dithio(dibenzoyl chloride), bis(4-chlorocarbonylphenyl) disulfide, dimethyl 4,4'-dithiodibutyrate, N,N'-bis(4-carbomethoxybenzoyl)-4,4'-dithiodianiline, bis(3-carboxyphenyl) disulfide, bis(2-carboxyphenyl) disulfide, 2,3'-dicarboxydiphenyl disulfide, 2,4'-dicarboxydiphenyl disulfide, 3,4'-dicarboxydiphenyl disulfide, bis(4-carboxymethylphenyl) disulfide, bis(3-carboxymethylphenyl) disulfide, bis(2-carboxymethylphenyl) disulfide, bis(10-carboxy-n-decyl) disulfide, 3,3'-dithiodipropionic acid, N,N'-bis(beta-carboxypropionyl)-4,4'-dithiodianiline, N,N'-bis(-gamma-carboxybutyryl)-2,2'-dithiodianiline, bis(3-carboxy-1-methylpropyl) disulfide, bis(2,3-dimethoxy-6-carboxyphenyl) disulfide, bis(4-carboxy-methoxyphenyl) disulfides and diisocyanate disulfides; and said diol is chosen from the group consisting of ethylene glycol, diethylene glycol, triethylene glycol, 1,3-propanediol, 1,2-propanediol, 1,4-butanediol, 2-methyl-1,5-pentanediol, 1,4-cyclohexanedimethanol, 1,4-bis($\beta$-hydroxyethoxy)cyclohexane, norcamphanediols, 2,2,4,4-tetraalkylcyclobutane-1,3-diols, p-xylene glycol, neopentyl glycol, hydroquinone, 4,4'-isopropylidenediphenol, and hydroxy-terminated polyesters.

16. A method of making polymeric toner particles according to claim 12, wherein said vinyl monomer is chosen from the group consisting of substituted and unsubstituted styrenes, vinyl naphthalene, ethylenically unsaturated mono-olefins, vinyl halides, vinyl esters, esters of alpha-methylene aliphatic monocarboxylic acids, acrylonitrile, methacrylonitrile, acrylamide, vinyl ethers, vinyl ketones, vinylidene halides, N-vinyl compounds, and mixtures thereof.

17. A method of making polymeric toner particles according to claim 12, further comprising the step of adding a crosslinking agent to the vinyl monomer and the chain transfer polyester in said reacting, wherein said crosslinking agent is chosen from the group consisting of alphatic and aromatic divinyl compounds, diacrylates, dimethacrylates, diacrylamides, and dimethacrylamides.

18. A method of making polymeric toner particles according to claim 12, wherein said initiator is chosen from the group consisting of 2,2'-azobis(dimethyl valeronitrile), azobisisobutyronitrile, lauroyl peroxide, and azobismethylethylacetonitrile.

19. A method of making polymeric toner particles according to claim 12, wherein said stabilizer is chosen from the group consisting of silica, alumina, barium sulfate, calcium sulfate, barium carbonate, calcium carbonate, calcium phosphate, and latex-based copolymers.

20. A method of making polymeric toner particles according to claim 19, wherein said stabilizer is silica and further comprises the step of separating said silica stabilizer from the surface of said polymeric toner particles.

21. A method of making polymeric toner particles according to claim 12, wherein said promoters are chosen from the group consisting of poly(adipic acid-co-methylaminoethanol) and poly(diethanolamine adipate).

22. A method of making polymeric toner particles according to claim 12, wherein the droplets of the organic phase contain addenda chosen from the group consisting of colorants, and charge control agents.

23. A method of making polymeric toner particles according to claim 12, further comprising the step of mixing said polymeric toner particles with solid carrier particles to form a two component developer.

24. A method of making polymeric toner particles according to claim 1, wherein said reacting and said reducing comprise the steps of:

mixing said chain transfer polyester with a polymerizable vinyl monomer and an initiator to form an organic phase;

dispersing a stabilizer, a buffering agent, and a promoter in water to form an aqueous phase;

mixing said organic phase with said aqueous phase to form a suspension of small droplets of said organic phase in said aqueous phase; and polymerizing said vinyl monomer with said chain transfer polyester under conditions effective to form particles of a block copolymer having polyester blocks and polyvinyl blocks, wherein said polyester blocks and said polyvinyl blocks are linked together by a sulfide group previously constituting the disulfide moiety.

25. A method of making polymeric toner particles according to claim 24, wherein the conditions effective to form a chain-transfer polyester comprise heating the dicarboxylic acid and the glycol in the presence of a catalyst in an inert atmosphere at about 180° C. to about 280° C., and applying a vacuum at about 200° C. to about 280° C. to increase the molecular weight of said chain transfer polyester and to remove excess glycol.

26. A method of making polymeric toner particles according to claim 24, wherein:

said diacid is chosen from the group consisting of sebacic acid, 1,4-cyclohexanedicarboxylic acid, adipic acid, glutaric acid, succinic acid, carbonic acid, oxalic acid, azelaic acid, 4-cyclohexane-1,2-dicarboxylic acid, 2-ethylsuberic acid, 2,2,3,3-tetramethylsuccinic acid, 4,4'-bicyclohexyldicarboxylic acid, terephthalic acid, isophthalic acid, dibenzoic acid, bis(p-carboxyphenyl)methane, 2,6-naphthalenedicarboxylic acid, phenanthrene dicarboxylic acid, and 4,4'-sulfonyldibenzoic acid; and said diol is chosen from the group consisting of bis(-gamma-hydroxypropyl) disulfide, bis(6-hydroxyhexyl) disulfide, bis(6-hydroxy-2-naphthyl) disulfide, bis(4-hydroxyphenyl) disulfide, bis(4-hydroxymethylphenyl) disulfide, bis(2-hydroxymethylphenyl) disulfide, bis(4-(beta-hydroxyethyl)phenyl) disulfide, bis(3-(beta-hydroxyethyl)phenyl) disulfide.

27. A method of making polymeric toner particles according to claim 24, wherein:

said diacid is chosen from the group consisting of bis(4-carboxyphenyl) disulfide, bis(4-carbomethoxyphenyl) disulfide, 2,2'-dithio(dibenzoyl chloride), bis(4-chlorocarbonylphenyl) disulfide, dimethyl 4,4'-dithiodibutyrate, N,N'-bis(4-carbomethoxybenzoyl)-4,4'-dithiodianiline, bis(3-carboxyphenyl) disulfide, bis(2-carboxyphenyl) disulfide, 2,3'-dicarboxydiphenyl disulfide, 2,4'-dicarboxydiphenyl disulfide, 3,4'-dicarboxydiphenyl disulfide, bis(4-carboxymethylphenyl) disulfide, bis(3-carboxymethylphenyl) disulfide, bis(2-carboxymethylphenyl) disulfide, bis(10-carboxy-n-decyl) disulfide, 3,3'-dithiodipropionic acid, N,N'-bis(beta-carboxypropionyl)-4,4'-dithiodianiline, N,N'-bis(-gamma-carboxybutyryl)-2,2'-dithiodianiline, bis(3-carboxy-1-methylpropyl) disulfide, bis(2,3-dimethoxy-6-carboxyphenyl) disulfide, bis(4-carboxy-methoxyphenyl) disulfides and diisocyanate disulfides; and said diol is chosen from the group consisting of ethylene glycol, diethylene glycol, triethylene glycol, 1,3-propanediol, 1,2-propanediol, 1,4-butanediol, 2-methyl-1,5-pentanediol, 1,4-cyclohexanedimethanol, 1,4-bis(β-hydroxyethoxy)cyclohexane, norcamphanediols, 2,2,4,4-tetraalkylcyclobutane-1,3-diols, p-xylene glycol, neopentyl glycol, hydroquinone, 4,4'-isopropylidenediphenol, and hydroxy-terminated polyesters.

28. A method of making polymeric toner particles according to claim 24, wherein said vinyl monomer is chosen from the group consisting of substituted and unsubstituted styrenes, vinyl naphthalene, ethylenically unsaturated mono-olefins, vinyl halides, vinyl esters, esters of alpha-methylene aliphatic monocarboxylic acids, acrylonitrile, methacrylonitrile, acrylamide, vinyl ethers, vinyl ketones, vinylidene halides, N-vinyl compounds, and mixtures thereof.

29. A method of making polymeric toner particles according to claim 24, further comprising the step of adding a crosslinking agent to the vinyl monomer and the chain transfer polyester in said reacting, wherein said crosslinking agent is chosen from the group consisting of aliphatic and aromatic divinyl compounds, diacrylates, dimethacrylates, diacrylamides, and dimethacrylamides.

30. A method of making polymeric toner particles according to claim 24, wherein said initiator is chosen from the group consisting of 2,2'-azobis(dimethyl valeronitrile), azobisisobutyronitrile, lauroyl peroxide, and azobismethylethylacetonitrile.

31. A method of making polymeric toner particles according to claim 24, wherein said stabilizer is chosen from the group consisting of silica, alumina, barium sulfate, calcium sulfate, barium carbonate, calcium carbonate, calcium phosphate, and latex-based copolymers.

32. A method of making polymeric toner particles according to claim 31, wherein said stabilizer is silica and further comprises the step of separating said silica stabilizer from the surface of said polymeric toner particles.

33. A method of making polymeric toner particles according to claim 24, wherein said promoters are chosen from the group consisting of poly(adipic acid-co-methylaminoethanol) and poly(diethanolamine adipate).

34. A method of making polymeric toner particles according to claim 24, wherein the droplets of the organic phase contain addenda chosen from the group consisting of colorants, and charge control agents.

35. A method of making polymeric toner particles according to claim 24, further comprising the step of mixing said polymeric toner particles with solid carrier particles to form a two component developer.

36. An electrographic toner composition comprising:

a particulate block copolymer having polyester blocks and polyvinyl blocks, wherein said polyester blocks and said polyvinyl blocks are linked together by a sulfide group and addenda selected from the group consisiting of charge control agents and colorants.

37. An electrographic toner composition comprising:

a particulate block copolymer which is the polymerization product of a vinyl monomer and a chain transfer polyester, said chain transfer polyester containing a disulfide linkage and addenda selected from the group consisting of charge control agents and colorants.

38. The toner composition according to claim 37, wherein said particulate block copolymer has an average particle size of 0.2–60 μm and a relatively narrow particle size distribution.

* * * * *